US010058987B2

(12) United States Patent
Wiedner et al.

(10) Patent No.: US 10,058,987 B2
(45) Date of Patent: Aug. 28, 2018

(54) HAND-HELD POWER TOOL

(71) Applicant: Hilti Aktiengesellschaft, Schaan (LI)

(72) Inventors: Aaron Wiedner, Landsberg (DE); Markus Hartmann, Mauerstetten (DE)

(73) Assignee: Hilti Aktiengesellschaft, Schaan (LI)

( * ) Notice: Subject to any disclaimer, the term of this patent is extended or adjusted under 35 U.S.C. 154(b) by 583 days.

(21) Appl. No.: 13/938,421

(22) Filed: Jul. 10, 2013

(65) Prior Publication Data

US 2014/0014383 A1 Jan. 16, 2014

(30) Foreign Application Priority Data

Jul. 12, 2012 (DE) ..... 10 2012 212 231

(51) Int. Cl.
*B25D 11/06* (2006.01)
*B25D 17/06* (2006.01)

(52) U.S. Cl.
CPC ..... *B25D 11/06* (2013.01); *B25D 17/06* (2013.01); *B25D 2211/003* (2013.01); *B25D 2211/068* (2013.01); *B25D 2217/0015* (2013.01); *B25D 2217/0019* (2013.01); *B25D 2250/225* (2013.01); *B25D 2250/231* (2013.01); *B25D 2250/345* (2013.01)

(58) Field of Classification Search
CPC ..... B25D 17/06; B25D 9/04; B25D 11/125; B25D 11/06; B25D 16/006; B25D 2216/0023; B25D 2217/0019; B25D 2250/241
USPC ..... 173/201, 48
See application file for complete search history.

(56) References Cited

U.S. PATENT DOCUMENTS

| | | | |
|---|---|---|---|
| 4,567,951 | A | 2/1986 | Fehrle et al. |
| 5,111,890 | A | 5/1992 | Ranger et al. |
| 8,616,301 | B2 | 12/2013 | John et al. |
| 2004/0231869 | A1 | 11/2004 | Bernhart et al. |
| 2006/0248701 | A1 | 11/2006 | Bernhart et al. |
| 2008/0006420 | A1 | 1/2008 | Berghauser |
| 2008/0202782 | A1 | 8/2008 | Hartmann et al. |

(Continued)

FOREIGN PATENT DOCUMENTS

| | | |
|---|---|---|
| CN | 1502449 A | 6/2004 |
| CN | 101096092 | 1/2008 |
| DE | 3526996 | 2/1987 |

(Continued)

*Primary Examiner* — Michelle Lopez
(74) *Attorney, Agent, or Firm* — Davidson, Davidson & Kappel, LLC

(57) ABSTRACT

The hand-held power tool has a tool socket, a motor and a pneumatic striking mechanism. The striking mechanism has an exciter driven by the motor along a working axis, a striker coupled to the exciter via an air cushion, and an intermediate striker arranged between the striker and the tool socket in the striking direction. The striking mechanism also has a guide in which the intermediate striker is guided. The guide has a first sliding surface that guides a first section of the intermediate striker, and a second sliding surface that is arranged offset relative to the first sliding surface in the striking direction and that guides a second section of the intermediate striker. A radial dimension of the first section of the intermediate striker is greater than a radial dimension of the second section of the intermediate striker.

19 Claims, 3 Drawing Sheets

(56) References Cited

U.S. PATENT DOCUMENTS

| | | | | |
|---|---|---|---|---|
| 2010/0000748 | A1* | 1/2010 | Machida ..... | B25D 11/062 173/48 |
| 2011/0303429 | A1 | 12/2011 | Kohlschmied et al. | |

FOREIGN PATENT DOCUMENTS

| | | | |
|---|---|---|---|
| DE | 3826213 | A1 | 2/1990 |
| DE | 19651828 | | 6/1998 |
| DE | 102004024154 | | 12/2004 |
| DE | 10362025 | | 1/2005 |
| DE | 102009008190 | | 8/2010 |
| DE | 102009050014 | | 6/2011 |
| EP | 1048415 | | 11/2000 |
| EP | 1479485 | | 11/2004 |
| EP | 1754575 | | 2/2007 |
| EP | 1815947 | | 8/2007 |
| EP | 1955823 | | 8/2008 |
| EP | 2394793 | | 12/2011 |
| GB | 2313084 | | 11/1997 |
| GB | 2395456 | B | 7/2005 |

* cited by examiner

HAND-HELD POWER TOOL

This claims the benefit of German Patent Application DE 102012212231, filed Jul. 12, 2012 and hereby incorporated by reference herein.

The present invention relates to a chiseling or drilling-chiseling hand-held power tool.

SUMMARY OF THE INVENTION

It is an object of the present invention to provide a hand-held power tool having a tool socket, a motor and a pneumatic striking mechanism. The striking mechanism has an exciter driven by the motor along a working axis, a striker coupled to the exciter via an air cushion, and an intermediate striker arranged between the striker and the tool socket in the striking direction. The striking mechanism also has a guide in which the intermediate striker is guided. The guide has a first sliding surface that guides a first section of the intermediate striker, and a second sliding surface that is arranged offset relative to the first sliding surface in the striking direction and that guides a second section of the intermediate striker. A radial dimension of the first section of the intermediate striker is greater than a radial dimension of the second section of the intermediate striker. The intermediate striker is preferably guided on its section that is closest to the tool and on its section configured with the largest diameter. The guide length of the intermediate striker during operation is large since then, the intermediate striker is retracted into the guide essentially opposite to the striking direction. When an empty strike occurs, the intermediate striker typically slides in the striking direction until it reaches a stop. The guide length decreases in this process, which can give rise to a slight tilting of the intermediate striker. This slight tilting facilitates the switching off of the striking mechanism after an empty strike.

The present invention provides that in every position in the guide, the intermediate striker is in contact with the first sliding surface and with the second sliding surface. One embodiment provides that the length of the second sliding surface is less than 25% of the length of the second section of the intermediate striker. When the intermediate striker is moved, it slides out of the second sliding surface, as a result of which the guide length is shortened.

One embodiment provides that all of the sections of the intermediate striker arranged before the first section in the striking direction are not guided, preferably at least when the intermediate striker is in contact with a stop in the striking direction.

One embodiment provides that the first sliding surface and the second sliding surface are parallel to the working axis.

One embodiment provides that the first sliding surface and the second sliding surface are inner surfaces of a one-part sleeve. As a result, it can be particularly ensured that the axes of the preferably cylindrical sliding surfaces are arranged coaxially to each other.

In one embodiment, grooves are provided that run along the working axis in the first sliding surface and/or in the first section.

In one embodiment, a sealing ring is arranged on the second sliding surface. The second sliding surface and the second section of the intermediate striker are preferably sealed with each other so as to be air-tight and dust-tight. The sealing ring can facilitate the closure.

BRIEF DESCRIPTION OF THE DRAWINGS

The description that follows explains the invention on the basis of embodiments and figures provided by way of examples. The figures show the following.

Unless otherwise indicated, the same or functionally equivalent elements are designated by the same reference numerals in the figures.

DETAILED DESCRIPTION

Figure 1:
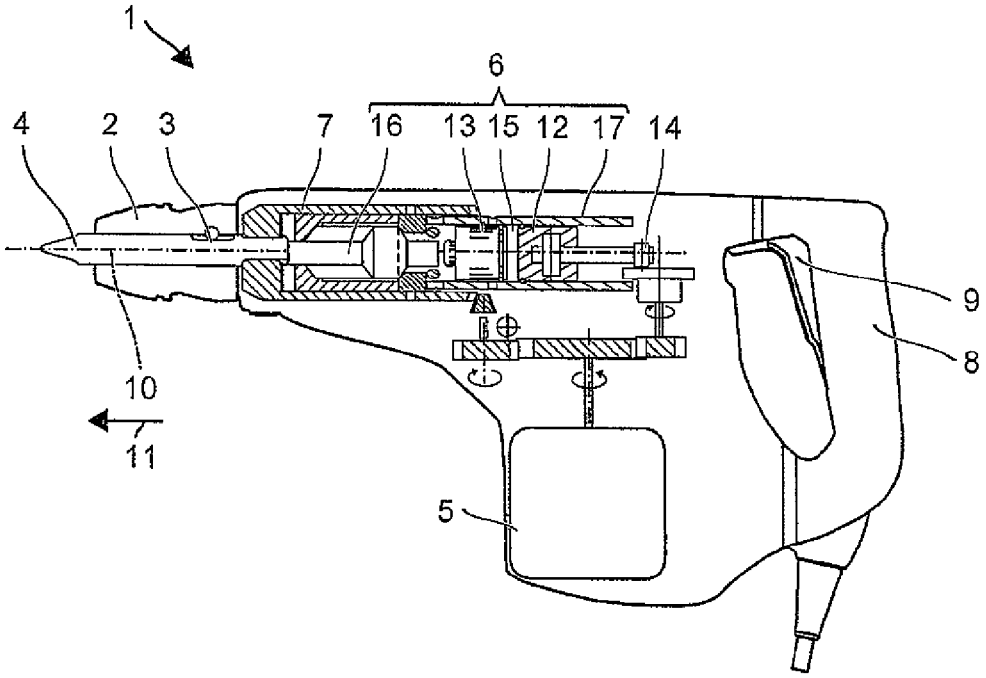
FIG. 1 a hammer drill.

FIG. 1 schematically shows a hammer drill 1 as an example of a chiseling hand-held power tool. The hammer drill 1 has a tool socket 2 into which a shank end 3 of a tool, e.g. a drill chisel 4, can be inserted. A motor 5 that drives a striking mechanism 6 and a drive shaft 7 constitute the primary drive of the hammer drill 1. A user can hold the hammer drill 1 by means of a handle 8 and can start up the hammer drill 1 by means of a system switch 9. During operation, the hammer drill 1 continuously rotates the drill chisel 4 around a working axis 10, and in this process, it can hammer the drill chisel 4 into a substrate in the striking direction 11 along the working axis 10.

The striking mechanism 6 is, for example, a pneumatic striking mechanism 6. An exciter 12 and a striker 13 are installed in the striking mechanism 6 so as to be movable along the working axis 10. The exciter 12 is coupled to the motor 5 via an eccentric 14 or a toggle element, and it is forced to execute a periodic linear movement. An air cushion formed by a pneumatic chamber 15 between the exciter 12 and the striker 13 couples the movement of the striker 13 to the movement of the exciter 12. The striker 13 strikes a rear end of the drill chisel 4 indirectly via an essentially stationary intermediate striker 16 and transmits part of its pulse to the drill chisel 4. The striking mechanism 6 and preferably the other drive components are arranged inside a machine housing 17.

Figure 2:
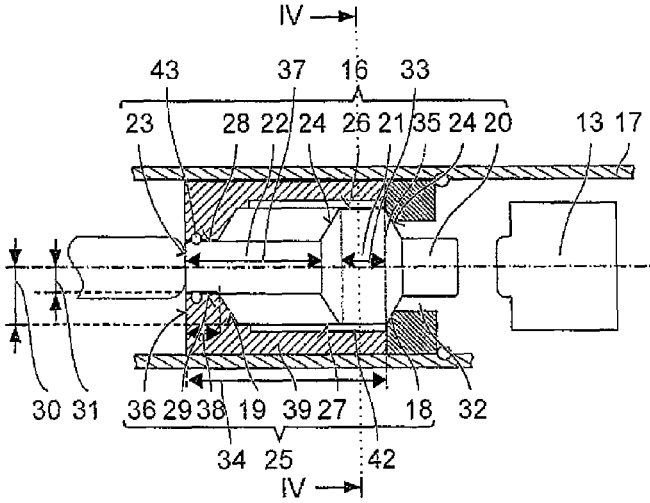
FIGS. 2, 3, 4 a striking mechanism.
Figure 4:
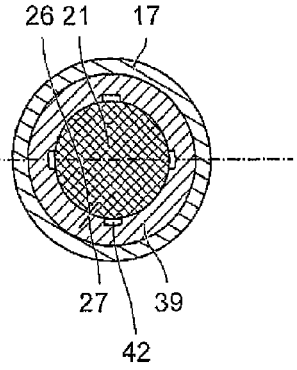

FIG. 1 and FIG. 2 illustrate the hammer drill 1 during working operation. The drill chisel 4 is in contact with a workpiece and is inserted into the tool socket 2 by the user. The drill chisel 4 pushes the intermediate striker 16 opposite to the striking direction 11 until its front stop 18 is reached. This position will be referred to below as the working point. The striker 13 can strike the intermediate striker 16 in the working position. In this process, the intermediate striker 16 moves forward in the striking direction by about the same distance as the hammer drill 1 penetrates into the workpiece. The pressure exerted by the user pushes the intermediate striker 16 back to its working point. The intrinsic weight of the hammer drill 1, when it is standing on the drill chisel 4, can push the intermediate striker 16 into the working point.

Figure 3:
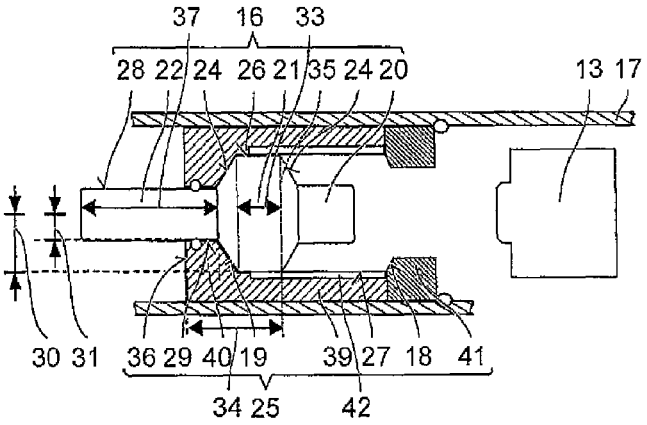

FIG. 3 illustrates the hammer drill 1 when the drill chisel 4 is lifted off the workpiece and no force is being exerted onto the drill chisel 4 against the striking direction 11. The intermediate striker 16 can slide in the striking direction 11 essentially without a counterforce from the working point all the way to a rear stop 19. This position will be referred to below as the empty strike position. Advantageously, the intermediate striker 16 remains in this empty strike position. The striker 13 no longer hits the intermediate striker 16, as a result of which, among other things, the pneumatic striking mechanism 6 is deactivated. In particular, the striker 13 does not undergo a recoil after the impact onto the intermediate striker 16 so as to move synchronously with the exciter 12.

The intermediate striker 16 has three consecutive cylindrical sections in the striking direction 16, namely, a front section 20, a middle section 21 and a rear section 22. With its surface 23 facing in the striking direction 11, the rear section 22 strikes the drill chisel 4. The diameter of the rear section 22 is adapted to the diameter of the shank ends 3 that can be held in the tool socket 2. Typically, the diameters are adapted to each other within a precision of about 10%. The diameter of the front section 20 can be configured so as to be largely the same as that of the rear section 22. The middle section 21 has a larger diameter. The facets 24 that run diagonally to the working axis 10 and that are situated between the front section 20 and the middle section 21 or else between the middle section 21 and the rear section 22 form counterparts for a front stop 18 and a rear stop 19 of a guide 25 of the intermediate striker 16 in order to limit the movement of the intermediate striker 16 along the working axis 10. The entire intermediate striker 16 is essentially a solid of revolution.

The intermediate striker 16 can slide along the working axis 10 in a linear guide 25. The radial surface 26 of the middle section 21 of the intermediate striker 16 is in contact with the front sliding surface 27 of the linear guide 25, and the radial surface 28 of the rear section 22 of the intermediate striker 16 is in contact with a rear sliding surface 29 of the linear guide 25. The front sliding surface 27 and the rear sliding surface 29 are essentially parallel, preferably coaxial, to the working axis 10. The sliding surfaces 27, 29 are preferably configured so as to cylindrical or prismatic. The front sliding surface 27 is situated at a first radial distance 30 from the working axis 10, said distance being essentially the same as the radial dimension of the middle section 21 of the intermediate striker 16. The middle section 21 is thus guided with a slight radial play by the front sliding surface 27. The rear sliding surface 29 is situated at a second radial distance 31 from the working axis 10, said distance being essentially the same as the radial dimension of the rear section 22 of the intermediate striker 16. The rear section 22 is guided with a slight play by the rear sliding surface 29. The first radial dimension 30 is correspondingly larger than the second radial dimension 31. The front sliding surface 27 and the rear sliding surface 29 follow each other along the striking direction 11, preferably either directly or else only separated by a stop surface 19 that runs diagonally to the working axis 10.

The front section 20 of the intermediate striker 16 is not guided, either by the above-mentioned guide 25 or by any other structure. The front section 20 is at a radial distance from the guide 25. The entire front section 20 is preferably surrounded by a sleeve-like air gap 32. The air gap 32 has a thickness of at least 2 mm.

The entire length 33 of the middle section 21 is preferably in contact with the front sliding surface 27, irrespective of the position of the intermediate striker 16. The effective guide length 34 of the intermediate striker 16 varies as a function of its position between the basic position and the empty strike position. The effective guide length 34 is defined as the distance from the front-most edge 35 of the middle section 21 of the intermediate striker 16, as seen in the striking direction 11, to the rear-most edge 36 of the rear sliding surface 29. The guide length 34 is at its maximum in the basic position (FIG. 2). The middle section 21 is located as far away as possible from the rear sliding surface 29 and the stop 19. Tilting of the intermediate striker 16 is not possible at all or else only to a negligible extent. The guide length 34 is at its minimum in the empty strike position (FIG. 3). The middle section 21 adjoins the rear sliding surface 29 almost directly. The markedly reduced guide length 34 allows tilting of the intermediate striker 16 vis-à-vis the working axis 10 to a limited extent. This can be advantageous for switching off the striking mechanism in the case of an empty strike. In the empty strike position, the effective guide length 34 can be less than half its length in the basic position.

The rear section 22—relative to its length 37—is only partially in contact with the rear sliding surface 29. A length 38 of the rear sliding surface 29 is considerably less than a length 37 of the rear section 22 of the intermediate striker 16. The ratio of the lengths 37, 38 is within the range from 5% to 25%. The rear section 22 is pushed out of the rear sliding surface 29 in the striking direction 11. Consequently, the area of the intermediate striker 16 that is touched by the first sliding surface 27 migrates along the intermediate striker 16, for instance, relative to the end faces. The touched area has an edge 36 that is located rear-most in the striking direction 11 and that limits the effective length 34.

The guide 25 is formed, for example, by a hollow cylindrical sleeve 39. The sleeve 39 has a diameter that corresponds to the radial dimension 30 of the front sliding surface 27. The length of the sleeve 39 corresponds to the maximum guide length 34, that is to say, the guide length 34 in the basic position. At its rear end in the striking direction 11, the sleeve 39 has a cantilevered edge 40 that turns into a circular opening that forms the rear sliding surface 29. At the same time, the cantilevered edge 40 forms the rear stop 19. A radius of the opening corresponds to the second radial dimension 31. A ring 41 is arranged directly in front of the sleeve 39 in the striking direction 11. The ring 41 forms the front stop 19. The ring 41 can be made of an elastic or damping material.

The front sliding surface 27 can move away from the working axis 10 in the striking direction 11. For example, the front sliding surface 27 is configured so as to be conical. The inclination is preferably less than 5°, for instance, less than 2°. The forced guidance of the intermediate striker 16 along the working axis 10 preferably decreases even more from the working point towards the empty striker position.

Together with the intermediate striker 16, the guide 25 encloses a cavity that is limited by the rear stop 19 and the first sliding surface 27. The air can escape from the cavity via grooves 42 present in the sleeve 39. The grooves 42 are embossed into the first sliding surface 27 along the working axis 10. The grooves 42 preferably extend over the entire length of the first sliding surface 27.

The sliding surface 29 is preferably sealed air-tight with the intermediate striker 16. A sealing ring 43 can be embedded in the rear sliding surface 29 in order to compensate for tolerances and to ensure permanent sealing. No sealing element is provided on the front sliding surface 27 and on the middle section 21.

Figure 5:
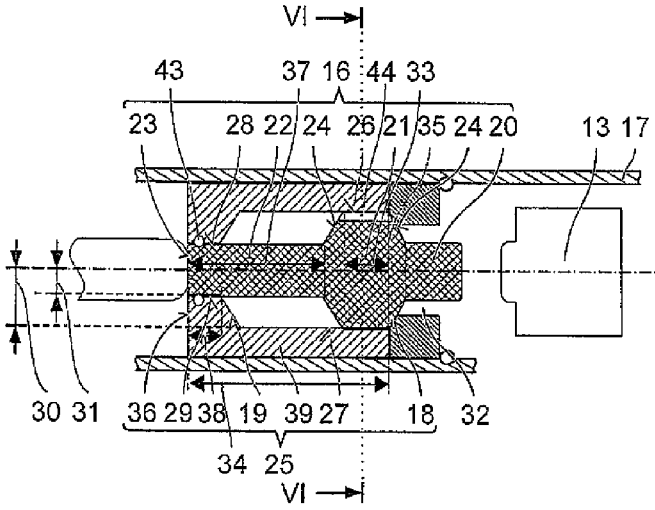
FIGS. 5, 6 another striking mechanism.
Figure 6:
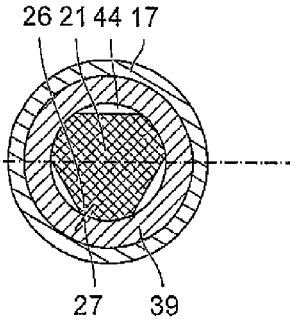

FIG. 5 and FIG. 6 show another embodiment. The intermediate striker 16 is guided on its middle section 22 by the front sliding surface 27, while its rear section 22 is guided by the rear sliding surface 29 of the guide 25. The front section 20 is not guided. The middle section 21 is provided with several grooves 44 running along the working axis 10 or with wrench flats.

Figure 7:
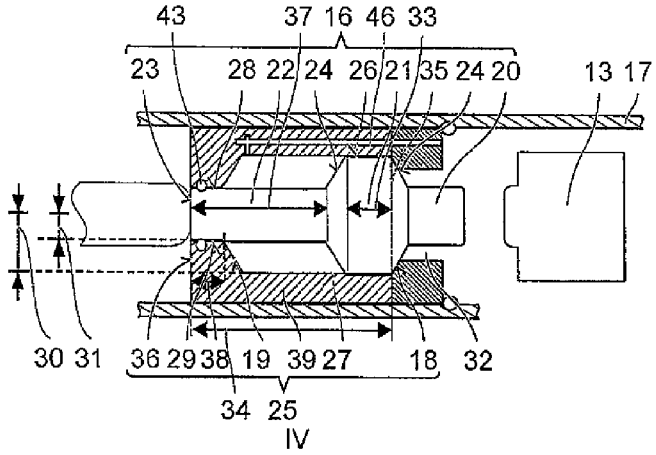
FIG. 7 another striking mechanism 6.

FIG. 7 shows another embodiment. The intermediate striker 16 is guided on its middle section 22 by the front sliding surface 27, while its rear section 22 is guided by the rear sliding surface 29 of the guide 25. In the front sliding surface 27, there is an opening leading to a venting channel 46. The opening is preferably close to the rear stop 19 for the intermediate striker 16. The venting channel 46 runs from the opening, preferably opposite to the striking direction 11. The cavity between the rear stop 19 and the intermediate striker 16 is connected via the venting channel 46, preferably to a dust-free space, for example, the space between the intermediate striker 16 and the striker 13.

What is claimed is:

1. A hand-held power tool comprising:

a tool socket;

a motor; and a pneumatic striking mechanism having an exciter driven by the motor along a working axis, a striker coupled to the exciter via an air cushion, an intermediate striker arranged between the striker and the tool socket in the striking direction, and a guide in which the intermediate striker is guided, the guide having a first sliding surface guiding a first section of the intermediate striker and a second sliding surface arranged offset relative to the first sliding surface in the striking direction and guiding a second section of the intermediate striker, a radial dimension of the first section of the intermediate striker being greater than a radial dimension of the second section of the intermediate striker;

the intermediate striker having a front section in a direction of the striker, the front section being unguided when the intermediate striker is in contact with a stop in the striking direction; wherein all further sections of the intermediate striker arranged before the first section in the striking direction are not guided, at least when the intermediate striker is in contact with the stop in the striking direction.

2. The hand-held power tool as recited in claim 1 wherein in every position in the guide, the intermediate striker is in contact with the first sliding surface and with the second sliding surface.

3. The hand-held power tool as recited in claim 1 wherein a length of the second sliding surface is less than 25% of a section length of the second section.

4. The hand-held power as recited in claim 1 wherein the first sliding surface is parallel to the working axis or else at a distance from the working axis at an angle of less than 5° in the striking direction.

5. The hand-held power tool as recited in claim 1 wherein the first sliding surface and the second sliding surface are inner surfaces of a one-part sleeve.

6. The hand-held power tool as recited in claim 1 wherein at least one of the first sliding section and the first section have grooves running along the working axis.

7. The hand-held power tool as recited in claim 1 further comprising a sealing ring arranged on the second sliding surface.

8. The hand-held power tool as recited in claim 1 wherein the front section is a third section, the radial dimension of the first section being greater than a radial dimension of the third section.

9. The hand-held power tool as recited in claim 8 wherein the second section and the third section have a same diameter.

10. The hand-held power tool as recited in claim 9 wherein a first diagonal facet runs between the second section and the first section, and a second diagonal facet runs between the third section and the first section.

11. The hand-held power tool as recited in claim 10 wherein the first facet forms a counterpart for the stop.

12. The hand-held power tool as recited in claim 10 wherein the first facet forms a counterpart for a second stop in a direction opposite the striking direction.

13. The hand-held poser tool as recited in claim 1 wherein the intermediate striker is a solid body between an outer surface.

14. The hand-held power tool as recited in claim 1 wherein an entirety of the striker is in front of the intermediate striker.

15. A hand-held power tool comprising:

a tool socket;

a motor; and a pneumatic striking mechanism having an exciter driven by the motor along a working axis, a striker coupled to the exciter via an air cushion, an intermediate striker arranged between the striker and the tool socket in the striking direction, and a guide in which the intermediate striker is guided, the guide having a first sliding surface guiding a first section of the intermediate striker and a second sliding surface arranged offset relative to the first sliding surface in the striking direction and guiding a second section of the intermediate striker, a radial dimension of the first section of the intermediate striker being greater than a radial dimension of the second section of the intermediate striker;

the intermediate striker having a front section in a direction of the striker, the front section being unguided when the intermediate striker is in contact with a stop in the striking direction wherein the intermediate striker is a solid body between an outer surface.

16. A hand-held power tool comprising:

a tool socket;

a motor; and a pneumatic striking mechanism having an exciter driven by the motor along a working axis, a striker coupled to the exciter via an air cushion, an intermediate striker arranged between the striker and the tool socket in the striking direction, and a guide in which the intermediate striker is guided, the guide having a first sliding surface guiding a first section of the intermediate striker and a second sliding surface arranged offset relative to the first sliding surface in the striking direction and guiding a second section of the intermediate striker, a radial dimension of the first section of the intermediate striker being greater than a radial dimension of the second section of the intermediate striker;

the intermediate striker having a front section in a direction of the striker, the front section being unguided when the intermediate striker is in contact with a stop in the striking direction wherein the front section is a third section, the radial dimension of the first section being greater than a radial dimension of the third section and wherein the second section and the third section have a same diameter.

17. The hand-held power tool as recited in claim 16 wherein a first diagonal facet runs between the second section and the first section, and a second diagonal facet runs between the third section and the first section.

18. The hand-held power tool as recited in claim 17 wherein the first facet forms a counterpart for the stop.

19. The hand-held power tool as recited in claim 17 wherein the first facet forms a counterpart for a second stop in a direction opposite the striking direction.

* * * * *